US007165948B2

(12) United States Patent
Takeuchi et al.

(10) Patent No.: US 7,165,948 B2
(45) Date of Patent: Jan. 23, 2007

(54) EJECTOR

(75) Inventors: Hirotsugu Takeuchi, Nagoya (JP); Yoshitaka Tomatsu, Chiryu (JP); Masayuki Takeuchi, Nukata-gun (JP)

(73) Assignee: Denso Corporation, Kariya (JP)

( * ) Notice: Subject to any disclaimer, the term of this patent is extended or adjusted under 35 U.S.C. 154(b) by 262 days.

(21) Appl. No.: 10/435,786

(22) Filed: May 12, 2003

(65) Prior Publication Data

US 2003/0210987 A1 Nov. 13, 2003

(30) Foreign Application Priority Data

May 13, 2002 (JP) ..... 2002-136954

(51) Int. Cl.
*F04B 23/04* (2006.01)
*F04B 23/08* (2006.01)
*F04F 5/36* (2006.01)

(52) U.S. Cl. ..... 417/79; 417/88; 417/195

(58) Field of Classification Search ..... 417/79, 417/88, 195, 198
See application file for complete search history.

(56) References Cited

U.S. PATENT DOCUMENTS

| | | | | |
|---|---|---|---|---|
| 4,285,638 | A * | 8/1981 | Clark | 417/172 |
| 5,343,711 | A * | 9/1994 | Kornhauser et al. | 62/116 |
| 6,042,019 | A * | 3/2000 | Rusch | 239/85 |
| 6,228,508 | B1 | 5/2001 | Kassanits et al. | |
| 6,623,876 | B1 * | 9/2003 | Caron | 428/698 |
| 6,673,165 | B1 * | 1/2004 | Koga et al. | 148/325 |

OTHER PUBLICATIONS

Chinese Office Action dated Jul. 30, 2003 in corresponding Chinese Application No. 03125142.0 with English translation.

* cited by examiner

*Primary Examiner*—Charles G. Freay
(74) *Attorney, Agent, or Firm*—Harness, Dickey & Pierce, PLC

(57) ABSTRACT

A nozzle (41) is made of a sintered metal, and a pressure increasing portion (a mixing portion (42) and a diffuser (43)) is manufactured by plastic-forming a metal pipe. Accordingly, the nozzle (41) can be manufactured in a short time while high accuracy in machining is maintained. Thus, the cost of manufacturing an ejector (40) can be reduced.

17 Claims, 5 Drawing Sheets

EJECTOR

BACKGROUND OF THE INVENTION

1. Field of the Invention

The present invention relates to an ejector, that is a kinetic pump for transferring a fluid by entrainment with a working fluid discharged at high speed, and that is effectively applied to a refrigerator (hereinafter an "ejector cycle") in which the ejector is adopted as pump means to circulate a refrigerant.

2. Description of the Related Art

A nozzle of an ejector accelerates a working fluid by decompressing the working fluid. Accordingly, the shape of the inner wall of the nozzle that is in contact with the working fluid requires a high accuracy in machining, i.e., a high accuracy in dimension and a predetermined surface roughness.

In the ejector for an ejector cycle, a speed energy is converted to a pressure energy during mixing of a refrigerant injected from the nozzle and a refrigerant sucked from an evaporator in a pressure increasing portion. Accordingly, similar to the shape of the inner wall of the nozzle, the shape of the inner wall of the pressure increasing portion requires a high accuracy in machining.

Therefore, conventionally, the nozzle is manufactured by electrical discharge machining or wire cut electric spark machining and the pressure increasing portion is manufactured by cutting. However, in the electrical discharge machining, the wire cut electric spark machining and the cutting, it is difficult to reduce the number of man-hours, i.e., the time of machining and, therefore, it is difficult to reduce the cost of manufacturing of the ejector.

SUMMARY OF THE INVENTION

In view of the above problems, the first object of the present invention is to provide a new ejector different from a conventional one, and the second object is to reduce the cost of manufacturing of the ejector.

In order to archive above objects, according to a first aspect of the present invention, there is provided an ejector, which is a kinetic pump for transferring a fluid by entrainment of a working fluid discharged from a nozzle (41) at high speed, wherein the nozzle (41) is sintered at high temperature after compression-molding fine particles.

Accordingly, the nozzle (41) can be manufactured in a short time while a high accuracy in machining is maintained. Thus, a new ejector different from a conventional one can be obtained, and the cost of manufacturing of the ejector can be reduced.

According to a second aspect, the nozzle (41) is made of a metal.

According to a third aspect, the nozzle (41) is sintered after being compression-molded so that the filling rate of the fine particles is not less than 96%.

Thus, the nozzle (41) can be prevented from being damaged due to cavitation because the hardness of the nozzle (41) is improved.

According to a fourth aspect, there is provided an ejector, which is a kinetic pump for transferring a fluid by entrainment of a working fluid discharged from a nozzle (41) at high speed, wherein the nozzle (41) is sintered at high temperature after compression-molding metal powders, and has an inner surface on which a film of nickel is formed.

Accordingly, the nozzle (41) can be manufactured in a short time while a high accuracy in machining is maintained.

Thus, a new ejector different from a conventional one can be obtained, and the cost of manufacturing of the ejector can be reduced.

Also, the nozzle (41) can be prevented from being damaged due to cavitation because the hardness of the inner surface covered with a film of nickel is improved.

According to a fifth aspect, there is provided an ejector being applied to a vapor-compression refrigerator which has a radiator for radiating a refrigerant having high temperature and pressure that is compressed by a compressor (10) and an evaporator (30) for evaporating a decompressed refrigerant having low temperature and pressure and transmits heat from a low temperature side to a high temperature side, comprising a nozzle (41) for decompressing and expanding the refrigerant by converting a pressure energy of the refrigerant, which emitted from the radiator (20), to a speed energy; and pressure increasing portions (42, 43) for increasing the pressure of the refrigerant by converting a pressure energy to a speed energy while mixing the refrigerant injected from the nozzle (41) and the refrigerant sucked from the evaporator (30), wherein the pressure increasing portions (42, 43) are manufactured by deforming a pipe by plastic forming.

Accordingly, the pressure increasing portion can be manufactured in a short time while a high accuracy in machining is maintained. Thus, a new ejector different from a conventional one can be obtained, and the cost of manufacturing of the ejector can be reduced.

According to a sixth aspect, the pressure increasing portions (42, 43) are manufactured by deforming a pipe by swaging.

According to a seventh aspect, the pressure increasing portions (42, 43) are manufactured by deforming a pipe by press working.

According to an eighth aspect, the pressure increasing portions (42, 43) are manufactured by deforming a pipe by spinning.

The numerical reference attached in parentheses to the component names described above are given to show an example of correspondence to specific components of embodiments to be described later.

The present invention may be more fully understood from the description of preferred embodiments of the invention set forth below, together with the accompanying drawings.

DESCRIPTION OF PREFERRED EMBODIMENTS

Figure 1:
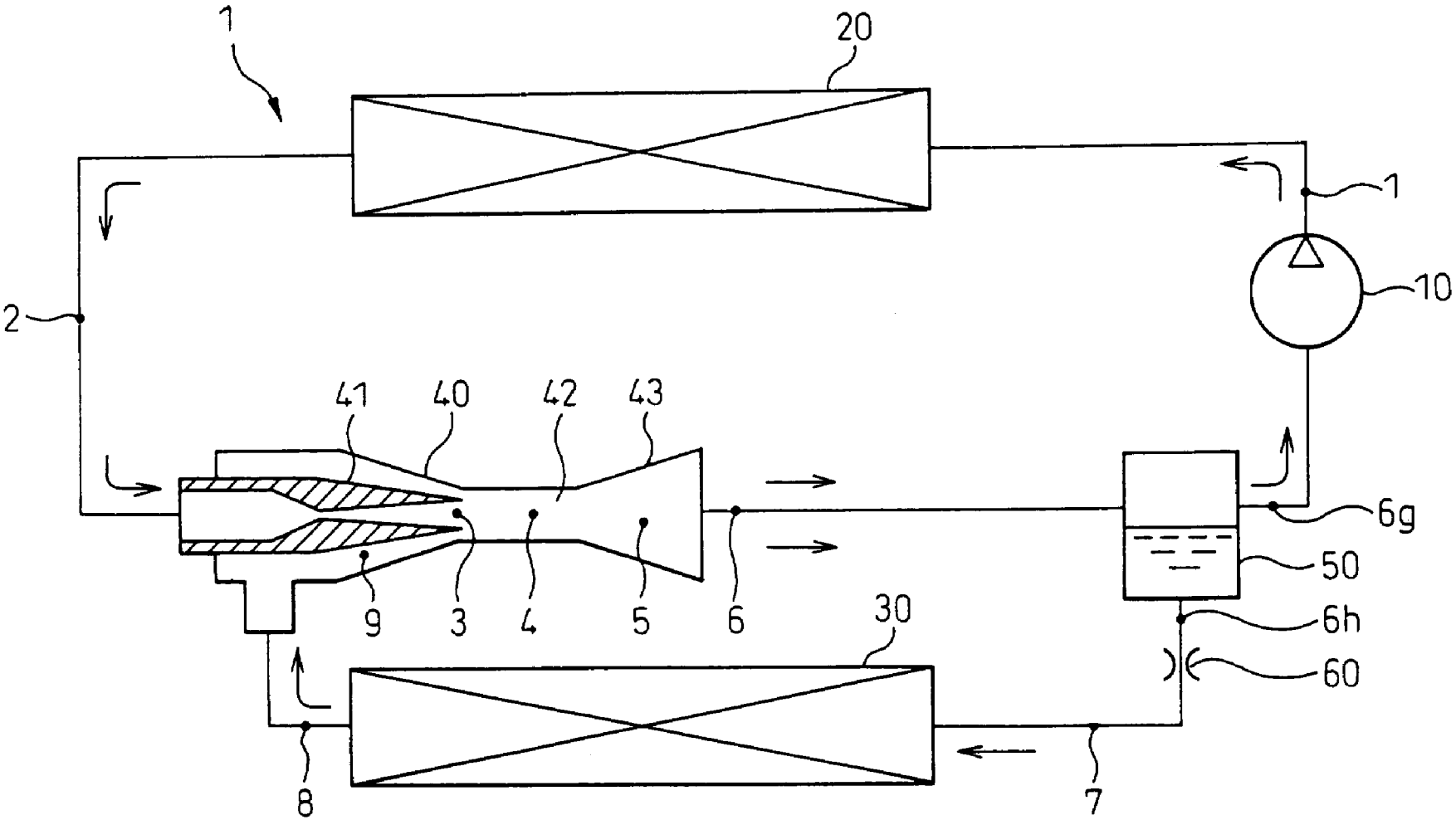
FIG. 1 is a schematic view of a first embodiment of an ejector cycle according to the present invention.
Figure 2:
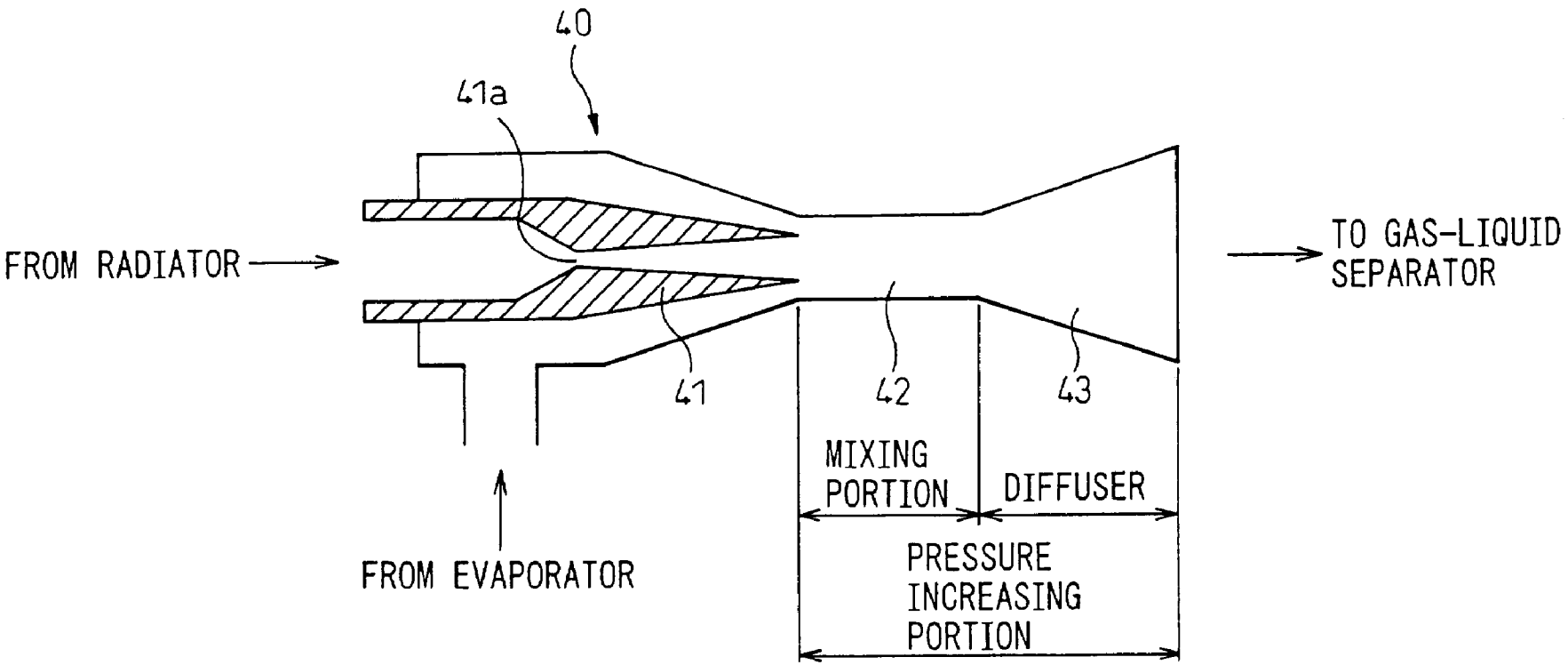
FIG. 2 is a schematic view of a first embodiment of an ejector according to the present invention.
Figure 3:
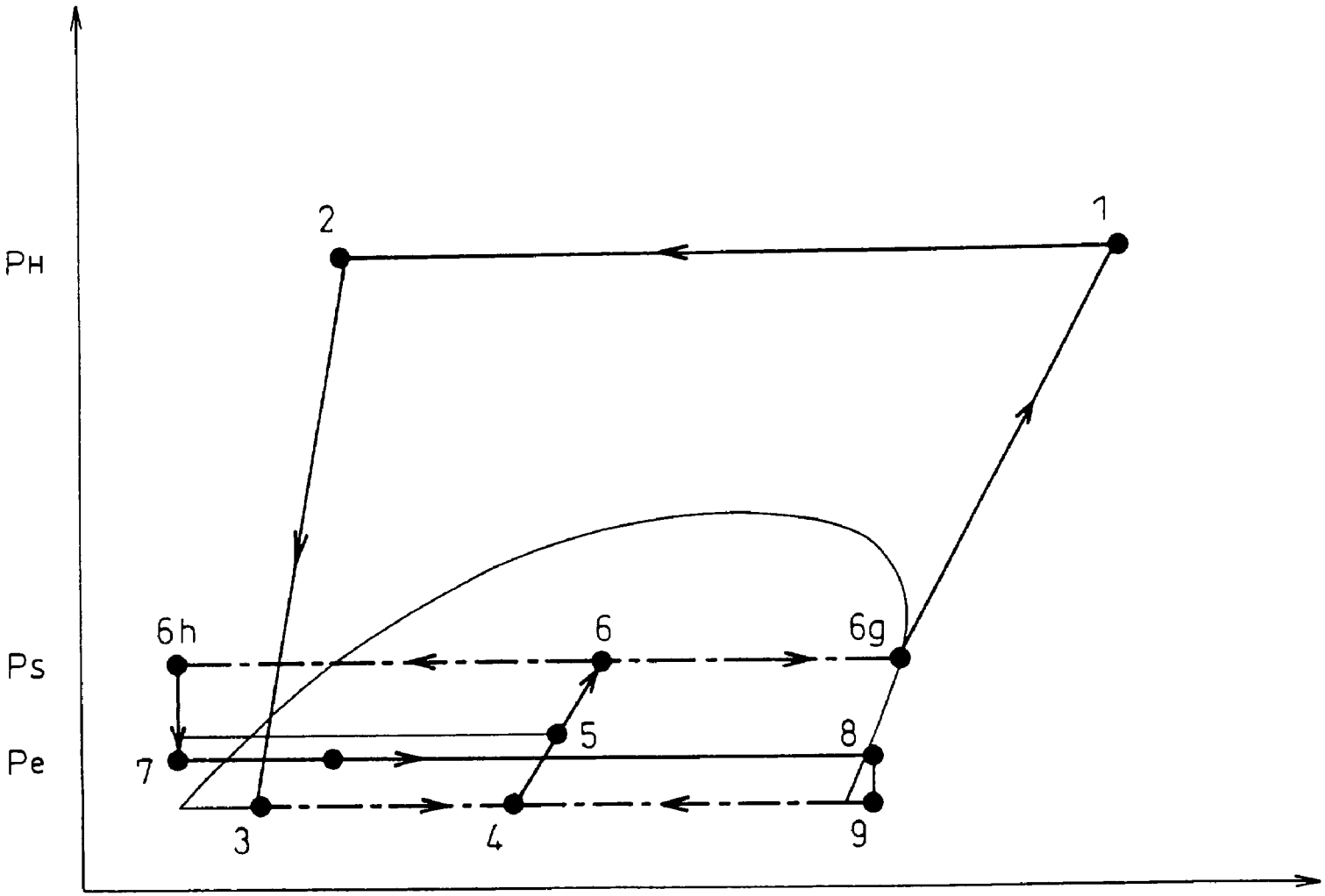
FIG. 3 is a p-h diagram.

A first embodiment of the present invention will be described below. In the present embodiment, an ejector according to the present invention is applied to an ejector cycle for a vehicle air conditioner. FIG. 1 is a schematic view of an ejector cycle 1 using freon (134*a*) or carbon dioxide as a refrigerant. FIG. 2 is a schematic view of an ejector 40. FIG. 3 is a p-h diagram showing macroscopic operations of the entirety of the ejector cycle.

A compressor 10 is a known variable-capacitance compressor that sucks and compresses a refrigerant by the power obtained from an engine for moving a vehicle. A radiator 20 is a high pressure side heat-exchanger that carries out a heat-exchange between the refrigerant discharged from the compressor 10 and outside air so as to cool the refrigerant.

An evaporator 30 is a low pressure side heat-exchanger that carries out a heat-exchange between air flowing into the room and a liquid-phase refrigerant so as to evaporate the liquid-phase refrigerant to cool air flown into the room.

The ejector 40 decompresses the refrigerant to expand the same so as to suck a gas-phase refrigerant evaporated in the evaporator 30, and converts an expansion energy to a pressure energy so as to increase the inlet pressure of the compressor 10.

As shown in FIG. 2, the ejector 40 is composed of a nozzle 41 that converts a pressure energy of refrigerant to a speed energy, to isentropically decompress and expand the refrigerant; a mixing portion 42 that mixes the gas-phase refrigerant evaporated in the evaporator 30 and the refrigerant injected from the nozzle 41 while sucking the gas-phase refrigerant by the refrigerant injected from the nozzle 41 at high speed; a diffuser 43 that converts a speed energy to a pressure energy to pressurize the refrigerant while mixing the refrigerant injected from the nozzle 41 and the refrigerant sucked from the evaporator 30; and the like.

In the mixing portion 42, a driving flow and a suction flow of the refrigerant are mixed so that the sum of the kinetic momentum of the driving flow and the kinetic momentum of the sucking flow is conserved. Accordingly, the pressure (static pressure) of refrigerant is increased even in the mixing portion 42.

In the diffuser 43, the cross-sectional area of a passage thereof is gradually increased to convert a speed energy (dynamic pressure) of refrigerant to a pressure energy (static pressure). Accordingly, in the ejector 40, the pressure of refrigerant is increased in the mixing portion 42 and diffuser 43. Therefore, the mixing portion 42 and the diffuser 43 are collectively called a pressure increasing portion.

In the present embodiment, in order to accelerate the speed of refrigerant discharged from the nozzle 41 to the speed of sound or more, a Laval nozzle having a throat portion 41*a* at which the sectional area of a passage of the nozzle becomes smallest, is adopted. However, as a matter of course, a convergent nozzle may be adopted.

In FIG. 1, a gas-liquid separator 50 is gas-liquid separating means into which the refrigerant discharged from the ejector 40 flows and which separates the refrigerant into a gas-phase refrigerant and a liquid-phase refrigerant and stores the refrigerants. A gas-phase refrigerant outlet port and a liquid-phase refrigerant outlet port of the gas-liquid separator 50 are connected to the suction side of the compressor 10 and the inflow side of the evaporator 30, respectively. A throttle 60 is a decompressing means for decompressing the liquid-phase refrigerant discharged from the gas-liquid separator 50.

In the present embodiment, as shown in FIG. 3, a high-pressure refrigerant flowing into the nozzle 41 is pressurized to the critical pressure of the refrigerant or more in the compressor 10. Reference numerals indicated with black dots in FIG. 3 show the state of the refrigerant at positions indicated by the reference numerals with black dots in FIG. 1.

Operations of the ejector cycle will be briefly described below (see FIG. 3).

The refrigerant discharged from the compressor 10 is circulated toward the radiator 20. Thus, the refrigerant cooled in the radiator 20 is isentropically decompressed and expanded in the nozzle 41 of the ejector 40 and, then flows into the mixing portion 42 at the speed of sound or more.

The refrigerant evaporated in the evaporator 30 is sucked into the mixing portion 42 by a pumping operation associated with entrainment of the high-speed refrigerant flowing in the mixing portion 42. Accordingly, the low pressure side refrigerant is circulated through an arrangement of the gas-liquid separator 50, the throttle 60, the evaporator 30 and the ejector 40 (pressure increasing portion).

While the refrigerant (suction flow) sucked from the evaporator 30 and the refrigerant (driving flow) injected from the nozzle 41 are mixed in the mixing portion 42, the dynamic pressure of the refrigerant is converted to the static pressure of the refrigerant in the diffuser 43. After that, the refrigerant is returned to the gas-liquid separator 50.

A manufacturing method of the ejector 40 and features thereof will be described below.

1. Manufacturing Method of the Nozzle 41

In the present embodiment, the nozzle 41 is made of a sintered metal, i.e., metal (e.g., stainless steel) powder is charged into a die to compression-mold the nozzle 41 and, then, the nozzle is sintered at high temperature and pressure. The hardness of the nozzle 41 is improved by setting the filling rate of the metal powder into the die at 96% or more.

Normally, the filling rate of a sintered metal is set at about 80%. If the nozzle 41 is manufactured at a filling rate of 80%, the hardness is low and, therefore, there is a high possibility that the portion of the nozzle 41 subsequent to the throat portion 41*a* may be damaged due to cavitation occurred in the throat portion 41*a*. However, in the present embodiment, the portion of the nozzle 41 subsequent to the throat portion 41*a* can be prevented from being damaged due to cavitation (corroding) because the filling rate is set at 96% or more.

Therefore, the cost of manufacturing the ejector 40 can be reduced because the nozzle 41 can be manufactured in a short time while a high accuracy in machining is maintained.

2. Manufacturing Method of the Pressure Increasing Portion

Figure 4:
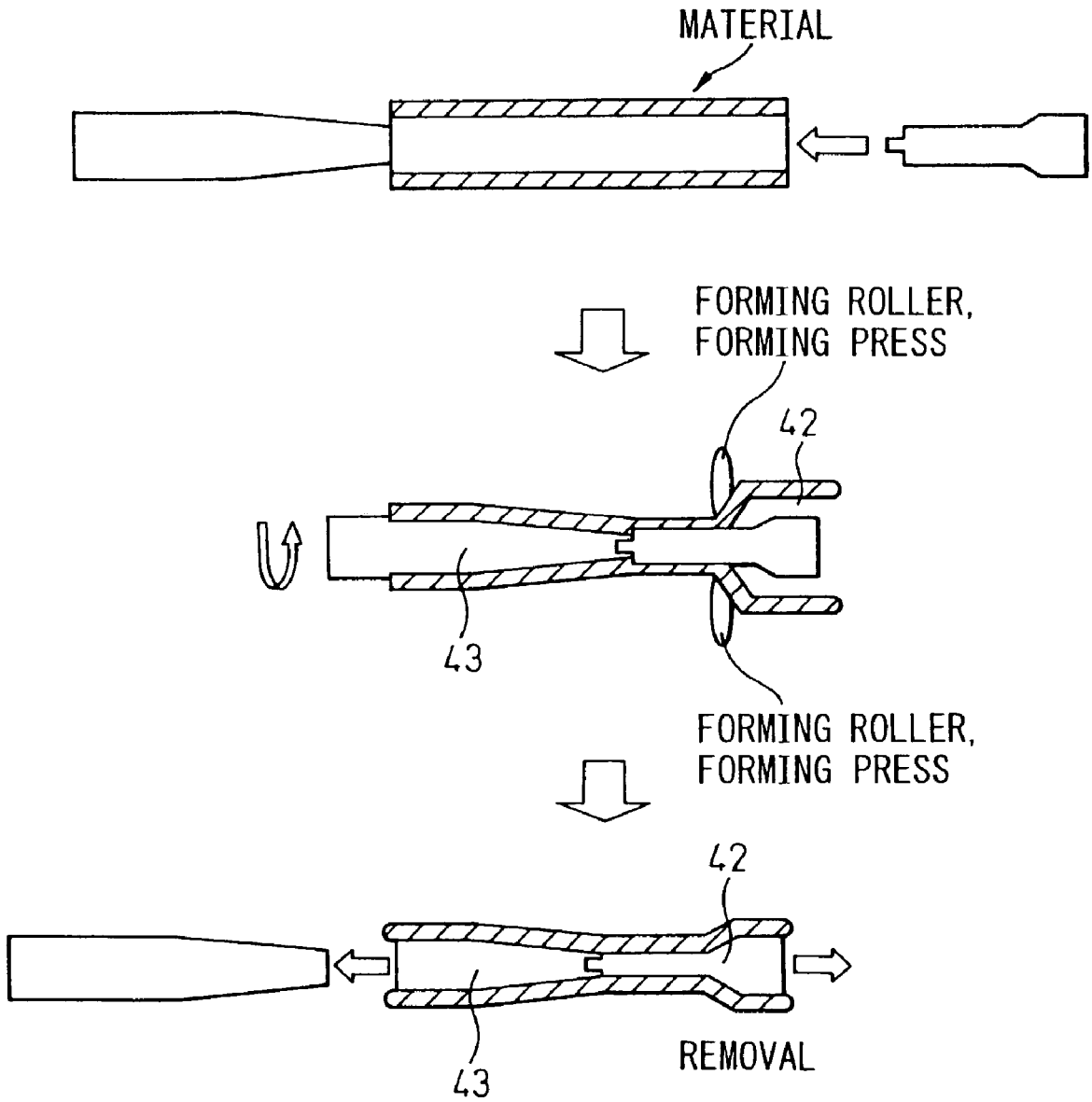
FIG. 4 is a schematic view of a manufacturing method of a pressure increasing portion according to a first aspect of the present invention.

In the present embodiment, as shown in FIG. 4, a pipe made of a metal (e.g., stainless steel) is deformed by plastic forming, to manufacture the pressure increasing portion.

A plastic forming method is, for example, swaging, press working, spinning and the like (see Japanese Industrial Standard B 0122).

Therefore, the cost of manufacturing of the ejector 40 can be reduced because the nozzle 41 can be manufactured in a short time while a high accuracy in machining is maintained.

A second embodiment will be described below. In the first embodiment, the filling rate of metal powder into the die is set at 96% or more, to improve the hardness of the nozzle 41. However, in the present embodiment, the inner surface of the nozzle 41 is coated with a nickel film by plating, to improve the hardness of the nozzle 41.

Figure 5:
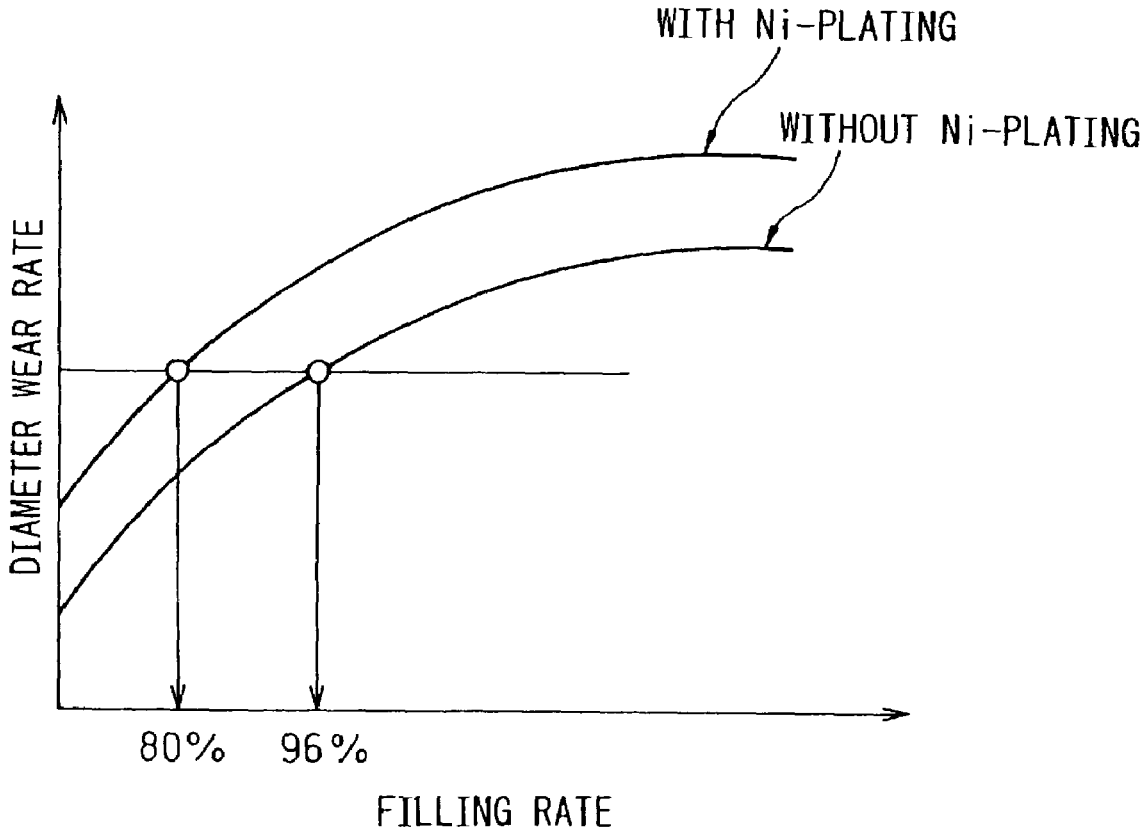
FIG. 5 is a graph of a filling rate and a wear rate of a nozzle.

FIG. 5 is a graph showing a relation between a filling rate and a wear rate. As is clear from FIG. 5, if the inner surface of the nozzle 41, i.e., the portion of the nozzle 41 which is in contact with the refrigerant, is coated with about 10 to 15 μm of nickel plating, the same hardness of the nozzle 41, as that at a filling rate of 96%, can be obtained even if the filling rate is set at about 80%.

Another embodiment will be described below. In the above-described embodiment, the nozzle 41 is made by sintering metal powder. However, the present invention is not limited thereto. The nozzle may be made by sintering, for example, ceramic powder.

In the second embodiment, the nickel film is formed on the inner surface of the nozzle 41. However, the material of the film is not limited to nickel.

While the invention has been described by reference to specific embodiments chosen for purposes of illustration, it should be apparent that numerous modifications could be made thereto by those skilled in the art without departing from the basic concept and scope of the invention.

The invention claimed is:

1. An ejector including a sintered stainless steel nozzle, the ejector being a kinetic pump for transferring a fluid by entrainment with a working fluid discharged from the nozzle, at a high speed, wherein the nozzle is sintered at high temperature after compression-molding metal powders, and has an inner surface on which a film of nickel is formed, the nozzle having a pre-sintered filling rate of between 80% and 96%.

2. An ejector according to claim 1, wherein the nozzle is sintered after being compression-molded so that the filling rate of the fine particles is not less than 96%.

3. An ejector according to claim 2, applied to a vapor-compression refrigerator which has a radiator for radiating a refrigerant having high temperature and pressure that is compressed by a compressor and an evaporator for evaporating a decompressed refrigerant having low temperature and pressure and transmits heat from a low temperature side to a high temperature side, comprising the nozzle for decompressing and expanding the refrigerant by converting a pressure energy of the refrigerant, which is emitted from the radiator, to a speed energy; and pressure increasing portions for increasing the pressure of the refrigerant by converting a speed energy to a pressure energy while mixing the refrigerant injected from the nozzle and the refrigerant sucked from the evaporator, wherein the pressure increasing portions are manufactured by deforming a pipe by plastic forming.

4. An ejector according to claim 3, wherein a swaged section of the ejector defines a pressure increasing portion.

5. An ejector according to claim 3, wherein a press worked section of the ejector defines a pressure increasing portion.

6. An ejector according to claim 3, wherein a spun section of the ejector defines a pressure increasing portion.

7. An ejector including a sintered stainless steel nozzle, the ejector being a kinetic pump for transferring a fluid by entrainment with a working fluid discharged from the nozzle at a high speed wherein the nozzle comprises a plurality of compressed and sintered fine particles.

8. An ejector according to claim 7, wherein the nozzle is sintered after being compression-molded so that the filling rate of the fine particles is not less than 96%.

9. An ejector according to claim 7, wherein the nozzle has an inner surface on which a film of nickel is formed.

10. An ejector according to claim 7, applied to a vapor-compression refrigerator which has a radiator for radiating a refrigerant having high temperature and pressure that is compressed by a compressor and an evaporator for evaporating a decompressed refrigerant having low temperature and pressure and transmits heat from a low temperature side to a high temperature side, comprising the nozzle for decompressing and expanding the refrigerant by converting a pressure energy of the refrigerant, which is emitted from the radiator, to a speed energy; and pressure increasing portions for increasing the pressure of the refrigerant by converting a speed energy to a pressure energy while mixing the refrigerant injected from the nozzle and the refrigerant sucked from the evaporator, wherein the pressure increasing portions are manufactured by deforming a pipe by plastic forming.

11. An ejector according to claim 7, wherein a swaged section of the ejector defines a pressure increasing portion.

12. An ejector according to claim 7, wherein a press worked portion of the ejector defines a pressure increasing portion.

13. An ejector according to claim 7, wherein a spun portion of the ejector defines a pressure increasing portion.

14. An ejector cycle in which an ejector is adopted as pump means, the ejector cycle comprising:

a compressor that sucks and compresses a refrigerant;

a high pressure side heat-exchanger that carries out a heat-exchange of the refrigerant discharged from the compressor;

a low pressure side heat-exchanger that evaporates the refrigerant; and an ejector, disposed between the high pressure side heat exchanger and the compressor, that decompresses the refrigerant from the high pressure side heat-exchanger and sucks a gas-phase refrigerant evaporated in the evaporator, wherein the ejector includes:

a sintered stainless steel nozzle having an inner surface defining a passage through which the refrigerant is injected; and a pressure increasing portion disposed on a downstream side of the nozzle, the pressure increasing portion being formed to convert a speed energy to a pressure energy while mixing the refrigerant injected from the nozzle and the refrigerant sucked from the evaporator, wherein the sintered stainless steel nozzle comprises a plurality of high temperature sintered compression molded fine particles made of stainless steel, and wherein the nozzle has a film of nickel formed on the inner surface.

15. The ejector cycle according to claim 14, wherein the fine particles are filled with a filling rate of not less than 80%.

16. The ejector cycle according to claim 15, wherein the fine particles are filled with the filling rate of not less than 96%.

17. The ejector cycle according to claim 14, wherein the pressure increasing portion includes a mixing portion and a diffuser portion, which are formed in a continuous shape by a deformed pipe made of metal.

* * * * *